US006190346B1

(12) United States Patent
McGill

(10) Patent No.: US 6,190,346 B1
(45) Date of Patent: Feb. 20, 2001

(54) SYSTEM FOR REDUCING EYELID DROOP

(76) Inventor: Judith J. McGill, 4246 Suzanne Dr., Pittsburg, CA (US) 94565

( * ) Notice: Under 35 U.S.C. 154(b), the term of this patent shall be extended for 0 days.

(21) Appl. No.: 09/343,326

(22) Filed: Jun. 30, 1999

(51) Int. Cl.[7] ..... A61F 13/12
(52) U.S. Cl. ..... 602/74; 602/54
(58) Field of Search ..... 602/54, 74

(56) References Cited

U.S. PATENT DOCUMENTS

| | | | | |
|---|---|---|---|---|
| 2,001,862 | * | 5/1935 | Battey | 606/204.35 |
| 3,949,741 | * | 4/1976 | Hofmann | 606/204.35 |
| 4,202,925 | | 5/1980 | Dabroski . | |
| 4,432,347 | | 2/1984 | Clavin . | |
| 4,653,483 | | 3/1987 | Clavin . | |
| 4,854,307 | | 8/1989 | Elfenbein . | |
| 5,144,944 | * | 9/1992 | Rice | 602/41 |

* cited by examiner

*Primary Examiner*—Michael A. Brown
*Assistant Examiner*—Lalita Hamilton
(74) *Attorney, Agent, or Firm*—Thomas R. Lampe

(57) ABSTRACT

A flexible strip having adhesive applied to only one side thereof is adhesively secured to the skin of a drooping eyelid with the upper edge of the strip located at a position a distance further from the ciliary margin of the eyelid than the distance of the normal supra tarsal fold from the ciliary margin. The outer side of the flexible strip is free of adhesive so that it will not restrict movement of eyelid skin engaging the outer side and so that makeup can be applied to the outer side.

2 Claims, 4 Drawing Sheets

SYSTEM FOR REDUCING EYELID DROOP

TECHNICAL FIELD

This invention relates to a method and apparatus employed to reduce or eliminate on a temporary basis the appearance of drooping or sagging eyelid skin without the use of surgical techniques.

BACKGROUND OF THE INVENTION

Over time, as part of the natural aging process, it is common for the skin of a person's upper eyelid to sag or droop. This not only can be unattractive, other consequences result as well, including impairment of vision. Loose, sagging or drooping eyelid skin can also interfere with the proper application of eye makeup.

Surgical techniques have been developed for alleviating the condition, the most common being the surgical removal of some of the upper eyelid. Any surgical procedure has its risks. Furthermore, such procedures can be relatively expensive. For this reason, there are many persons who choose to avoid the surgical option.

U.S. Pat. No. 4,432,347, issued Feb. 21, 1984, discloses a non-surgical approach for temporarily correcting eyelid skin droop. According to this patent the eyelid skin is stretched and a narrow, curved, adhesive strip having adhesive on both sides is applied to the skin. The skin is adhesively secured to both sides of the strip. Some of the skin is folded back upon itself with its edge along the bottom edge of the adhesive strip to form an artificial supra tarsal fold which is deeper and higher than the natural fold.

Such a device is somewhat difficult to apply and one has to have a major sagging problem in order for the procedure to be applicable. The double-sided adhesive causes some discomfort due to the restriction of movement of the skin and one cannot apply makeup to the device itself.

U.S. Pat. No. 4,854,307, issued Aug. 8, 1989, discloses an alternative approach wherein liquid adhesive is applied to the eyelid skin and the eyelid manipulated to adhesively secure together folded portions of the skin. Again one is presented with the situation of having the skin on both sides of the fold secured against relative movement. A certain degree of discomfort is likely to result. Furthermore, the application of the adhesive can be difficult for an untrained individual, possibly even requiring a specialized tool as shown in the patent. There is the potential for unsightly over-application of the adhesive and adhesive removal can be a problem.

A search directed to the present invention also located the following patents: U.S. Pat. No. 4,202,925, issued May 13, 1980, and U.S. Pat. No. 4,653,483, issued Mar. 31, 1987, the disclosure of the latter being closely related to the approach disclosed in above-described U.S. Pat. No. 4,432,347.

The invention disclosed and claimed herein is not taught or suggested by the above-referenced patents.

DISCLOSURE OF INVENTION

The present invention relates to a method and an apparatus which employ a flexible strip of material of a specified nature to temporarily reduce the droop associated with sagging eyelid skin, in particular the upper eyelid. In common with some of the prior art noted above, the present invention employs a flexible strip of material to accomplish the desired result. However, the flexible strip of material employed herein only has adhesive applied to one side thereof. This results in a number of advantages as compared to the prior art, including an increase in comfort level, ease of application, and allowing the user to apply makeup directly to the strip.

The method of the invention includes the step of positioning a flexible strip of material having an inner side and an outer side, an upper edge and a lower edge and adhesive applied only to the inner side thereof into engagement with the eyelid skin which forms the fold of an eyelid at a position wherein the upper edge of the flexible strip of material is located a distance from the ciliary margin of the eyelid greater than the distance of the supra tarsal fold from the ciliary margin.

The flexible strip of material is adhesively secured at the position with the adhesive, the adhesive being located between the inner side of the flexible strip of material and the eyelid skin, and the outer side of the flexible strip of material being unsecured to the eyelid skin.

The method also includes the step of folding the eyelid skin about the upper edge of the flexible strip of material after the flexible strip of material has been secured at the position so that a portion of the eyelid skin is disposed over the outer side of the flexible strip of material.

Also included in the method is the step of maintaining the portion of the eyelid skin which is disposed over the outer side of the flexible strip of material free of adhesive securement to the flexible strip of material whereby the portion of eyelid skin is freely movable relative to the outer side of the flexible strip of material.

Other features, advantages, and objects of the present invention will become apparent with reference to the following description and accompanying drawings.

MODES FOR CARRYING OUT THE INVENTION

Figure 1A:
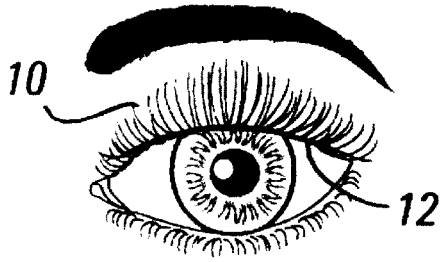
FIG. 1A illustrates an eye having a drooping upper lid, the lid being open.
Figure 1B:
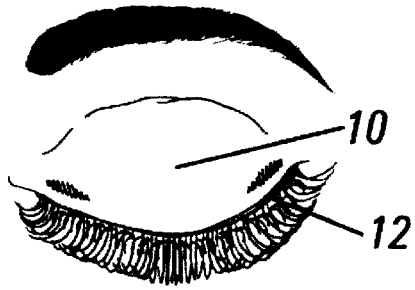
FIG. 1B is a view similar to FIG. 1A but illustrating the eyelid closed.
Figure 2A:
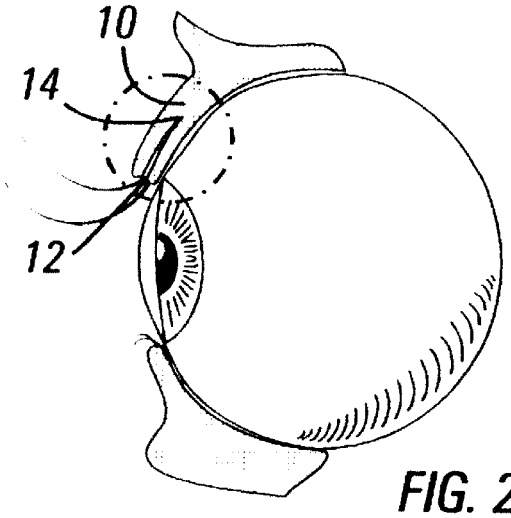
FIG. 2A is a simplified view of an eyeball and upper and lower eyelids.
Figure 2B:
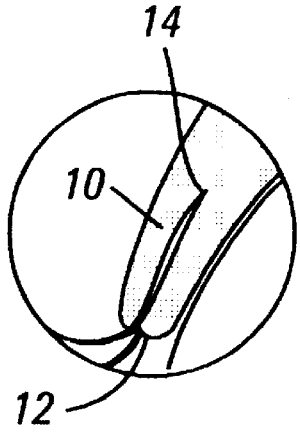
FIG. 2B is an enlarged view of that portion of the upper eyelid delineated by the circle in FIG. 2A.

FIG. 1A shows an eye having a droopy or sagging upper lid 10 having ciliary margin 12. The views of FIGS. 2A and 2B correspond to the view FIG. 1A. With reference to FIGS. 2A and 2B it will be noted that the drooping upper eyelid 10 forms a supra tarsal fold at the location designated by reference numeral 14, the fold being formed by overlapping layers of skin. In the drooping eyelid the outer layer of skin has drooped to a position in general registry with the underlying layer. The fold essentially disappears when the eyelid is closed as shown in FIG. 1B but the eyelid skin may still be quite loose for some people with a droopy lid problem.

Figure 1C:
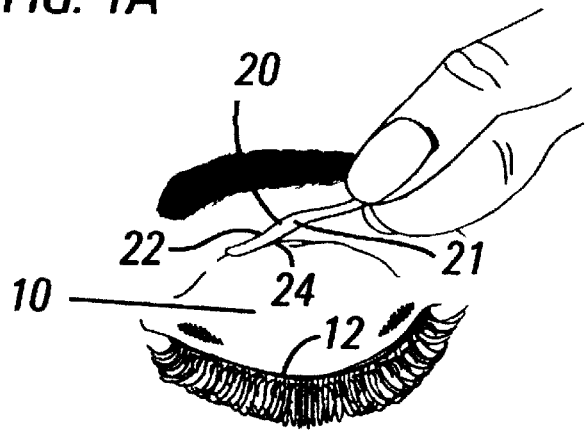
FIG. 1C illustrates the device of the present invention being positioned in place on the skin of the droopy lid.

In FIG. 1C a device 20 is being positioned in place on the upper eyelid while the eyelid is closed. Device 20 includes a flexible strip of material 21 such as that found in standard adhesive bandage strips and having a curved configuration. The strip has an inner side (the side facing the eyelid) and an outer side. The strip also includes an upper edge 22 and a lower edge 24.

Figure 5:
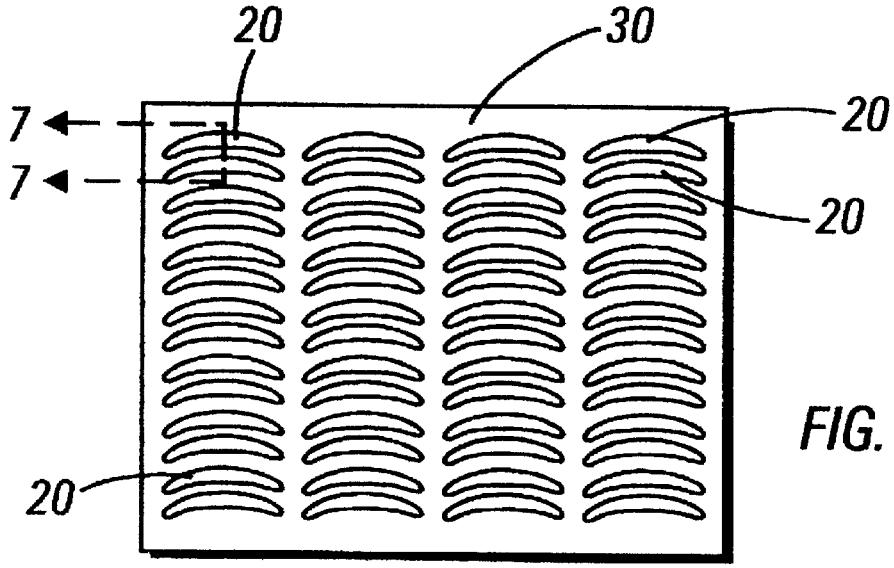
FIG. 5 is a plan view of a plurality of identical devices utilized when practicing the method of the present invention disposed on a carrier sheet.
Figure 6:
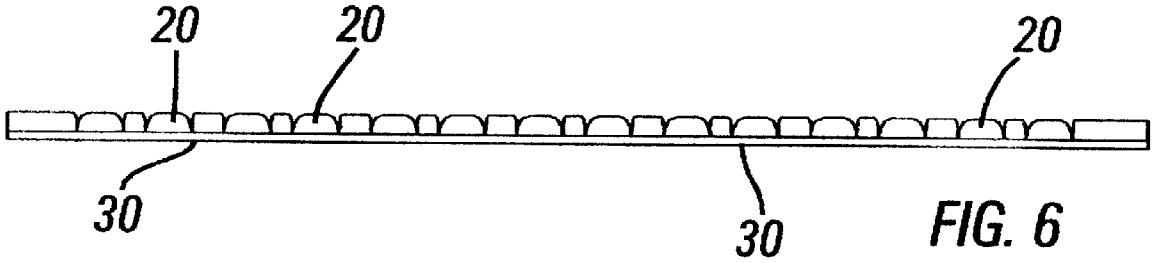
FIG. 6 is an enlarged elevational side view of the carrier sheet.
Figure 7:
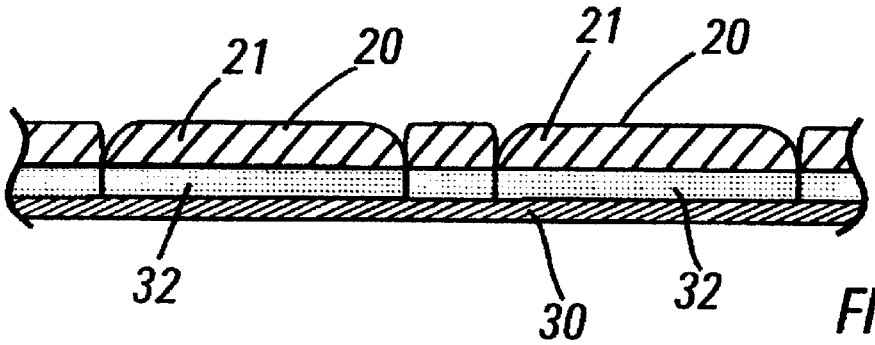
FIG. 7 is a greatly enlarged cross-sectional view taken along the line 7—7 in FIG. 5.

FIG. 5 shows a support sheet 30 having a plurality of devices 20 mounted thereon and adhesive 32 of any suitable type is applied to the inner side of each flexible strip 21. The support sheet 30 is constructed of any suitable material which will allow the entire device 20 (the flexible strip and adhesive) to be peeled away manually from the support sheet.

FIG. 1C illustrates the device 20 being placed into engagement with the eyelid skin that forms the supra tarsal fold of an eyelid at a position wherein the upper edge 22 is located a distance from the ciliary margin of the eyelid greater than the distance of the natural supra tarsal fold from the ciliary margin.

Figure 1D:
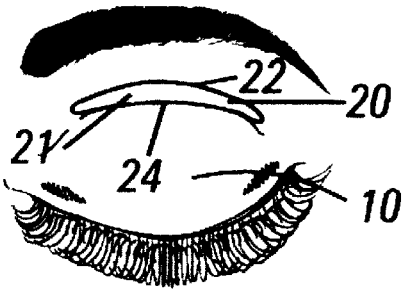
FIG. 1D shows the device adhesively secured in place on the lid.

The device 20 is then secured in place at the desired location as shown in FIG. 1D, the adhesive on the inner side of the flexible strip providing the sole means of securement. During the positioning step the upper edge of the flexible strip 21 may be pushed against the eyelid skin to bear against the eyelid skin and displace the eyelid skin away from the ciliary margin prior to the step of adhesively securing the flexible strip of material at the desired location.

Figure 1E:
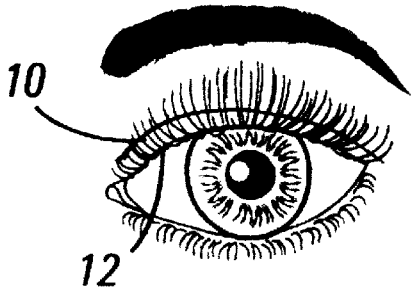
FIG. 1E shows the appearance of the eye with the lid open after application of the device according to the method of the present invention.

Upon opening of the eyelid as shown in FIG. 1E, the eyelid skin is folded about the upper edge of the flexible strip of material after the strip has been secured at the desired position so that a portion of the eyelid skin is disposed over the outer side of the flexible strip of material.

The portion of the eyelid skin which is disposed over the outer side of the flexible strip of material is maintained free of adhesive securement to the strip and that portion of eyelid skin is freely movable relative to the outer side of the flexible strip of material, greatly adding to the comfort and convenience of the wearer.

Depending upon the size and shape of the device 20 and the degree of sag, the device 20 may be completely hidden as shown in FIG. 1E or a portion thereof may be exposed. The fact that the outer side of the flexible strip 21 is free of adhesive enables the wearer to apply makeup to the strip.

Figure 3A:
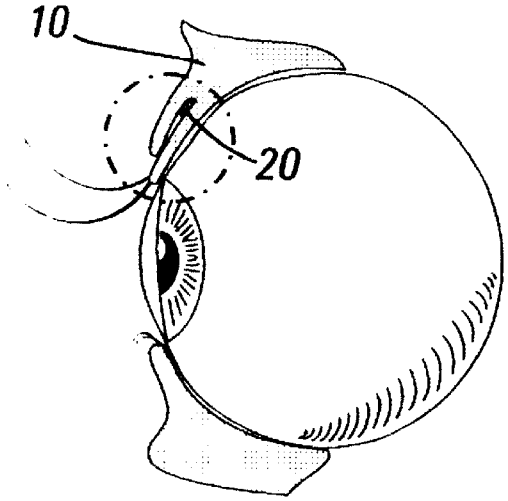
FIG. 3A is a view similar to FIG. 2A but illustrating the device employed in the present method in position at the upper eyelid.
Figure 3B:
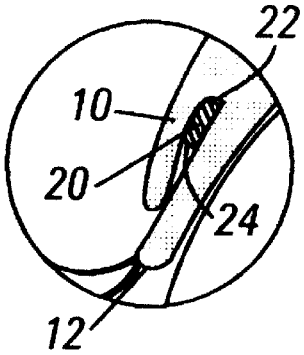
FIG. 3B is a view similar to FIG. 2B but illustrating the installed device.
Figure 4:
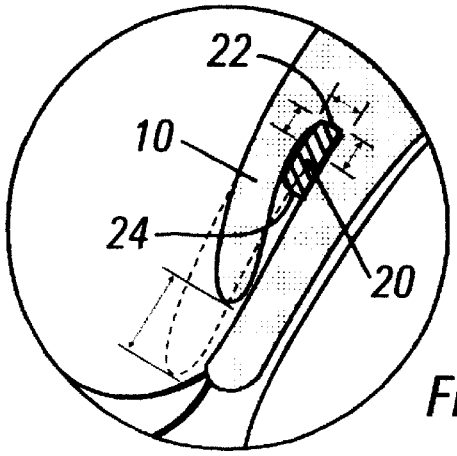
FIG. 4 is an enlarged schematic view of the area delineated by the dash lines in FIG. 3A providing a comparison between positions of an upper eyelid with the device and without the device.

In FIGS. 3A, 3B and FIG. 4, the device 20 is of a size relative to the eyelid enabling it to be completely concealed when the eyelid is open even though the device performs its task of tucking the skin to elevate the supra tarsal fold and maintain it in an elevated condition.

In FIG. 4, the outer layer of skin after practicing the method of the present invention is shown in solid lines while dash lines depict that layer in its drooped condition. FIG. 4 also illustrates in schematic fashion by double-headed arrows how the unit or device 20 can be adjusted relative to the eyelid prior to securement in place.

Figure 8:
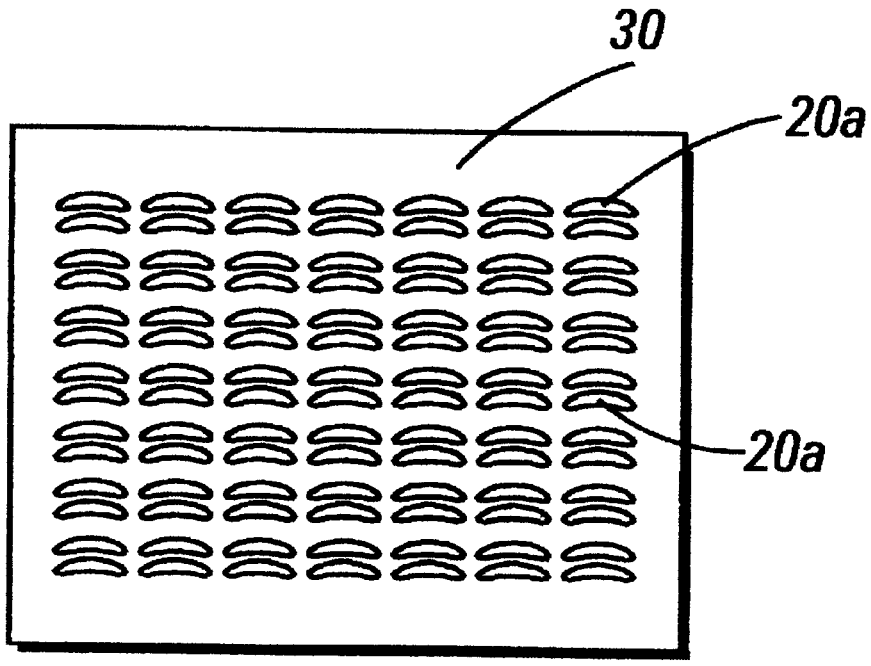
FIGS. 8 and 9 are views similar to FIG. 5 but illustrating different sized and shaped devices on carrier sheets.
Figure 9:
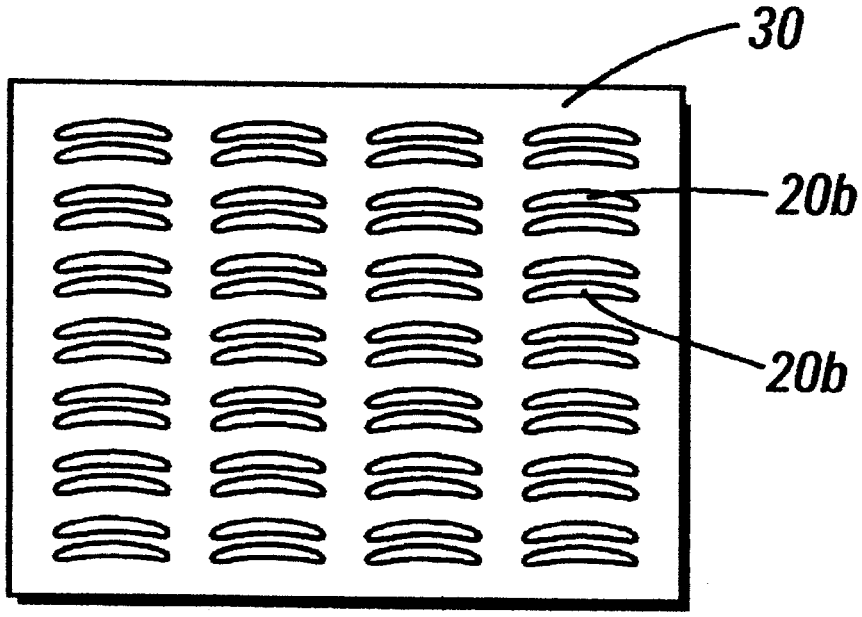

FIGS. 8 and 9 illustrate different device sizes and configurations, the devices in these figures being designated respectively by reference numeral 20*a* and 20*b*. As previously indicated, the support sheet 30 itself is made of any suitable material which will allow ready release of the adhesive 32 along with its associated flexible strip by manually pulling on the device.

What is claimed is:

1. A method for reducing eyelid skin droop, said method comprising the steps of:

positioning a flexible strip of material of single ply construction having an inner side and an outer side, an upper edge and a lower edge and adhesive applied only to the inner side thereof and covering the entire inner side thereof into engagement with the eyelid skin which forms the supra tarsal fold of an eyelid at a position wherein the upper edge of the flexible strip of material is located a distance from the ciliary margin of the eyelid greater than the distance of the supra tarsal fold from the ciliary margin;

adhesively securing the flexible strip of material at said position with said adhesive, said adhesive being located between the inner side of said flexible strip of material and the eyelid skin in registry with the flexible strip of single ply material and coextensive therewith, and the outer side of said flexible strip of material being maintained completely free of adhesive and unsecured to said eyelid skin;

folding the eyelid skin about the upper edge of said flexible strip of material after said flexible strip of material has been secured at said position so that a portion of said eyelid skin is disposed over the outer side of said flexible strip of material; and maintaining the portion of eyelid skin which is disposed over the outer side of said flexible strip of material free of adhesive securement to said flexible strip of material whereby said portion of eyelid skin is freely movable relative to the outer side of said flexible strip of material and whereby makeup can be applied to the outer side of said flexible strip of material after said flexible strip of material has been adhesively secured at said position, said step of adhesively securing the flexible strip of material at said position being carried out while the eyelid is substantially closed, and said positioning step including pushing the upper edge of said flexible strip of material against said eyelid skin to displace said eyelid skin in a direction away from said ciliary margin prior to the step of adhesively securing the flexible strip of material at said position.

2. The method according to claim 1 additionally comprising the step of applying makeup to the outer side of said flexible strip of material after the step of adhesively securing the flexible strip of material at said position.

* * * * *